United States Patent [19]

Bocard et al.

[11] 4,316,804

[45] Feb. 23, 1982

[54] METHOD AND SYSTEM FOR THE CONTINUOUS CLEANING OF UNDERWATER BEDS

[75] Inventors: Christian Bocard, Orgeval; Jacques Delacour, Paris; Philippe Renault, Noisy le Roi, all of France

[73] Assignee: Institut Francais du Petrole, Rueil-Malmaison, France

[21] Appl. No.: 163,894

[22] Filed: Jun. 27, 1980

[30] Foreign Application Priority Data

Jun. 29, 1979 [FR] France ..... 79 16893

[51] Int. Cl.[3] ..... B01D 35/00

[52] U.S. Cl. ..... 210/671; 134/6; 210/693; 210/242.4; 210/924

[58] Field of Search ..... 210/923, 924, 242.3, 210/242.4, 671, 693, 747, 170; 37/69, 72; 405/173, 74, 158, 60; 134/6; 119/2, 4

[56] References Cited

U.S. PATENT DOCUMENTS

| | | | |
|---|---|---|---|
| 19,930 | 4/1858 | Johnson | 37/69 |
| 3,889,403 | 6/1975 | Gauthier et al. | 37/69 |
| 3,908,290 | 9/1975 | Condolios | 37/72 |
| 4,146,477 | 3/1979 | Challener | 210/242.4 |

FOREIGN PATENT DOCUMENTS

| | | | |
|---|---|---|---|
| 19697 | 9/1956 | Fed. Rep. of Germany | 37/69 |
| 52-74885 | 6/1977 | Japan | 405/158 |
| 197805 | 11/1976 | Netherlands | 405/60 |

*Primary Examiner*—S. Leon Bashore
*Assistant Examiner*—Michael L. Goldman
*Attorney, Agent, or Firm*—Millen & White

[57] ABSTRACT

The system comprises a flexible line provided with means for collecting products scattered at the water bottom by circulating the flexible line in contact with these products. On the rising portion of the path followed by the flexible line, the collecting means are passed through a tubular casing for simultaneously protecting the surrounding water against pollution from products released, while hoisting the products to the surface.

15 Claims, 1 Drawing Figure

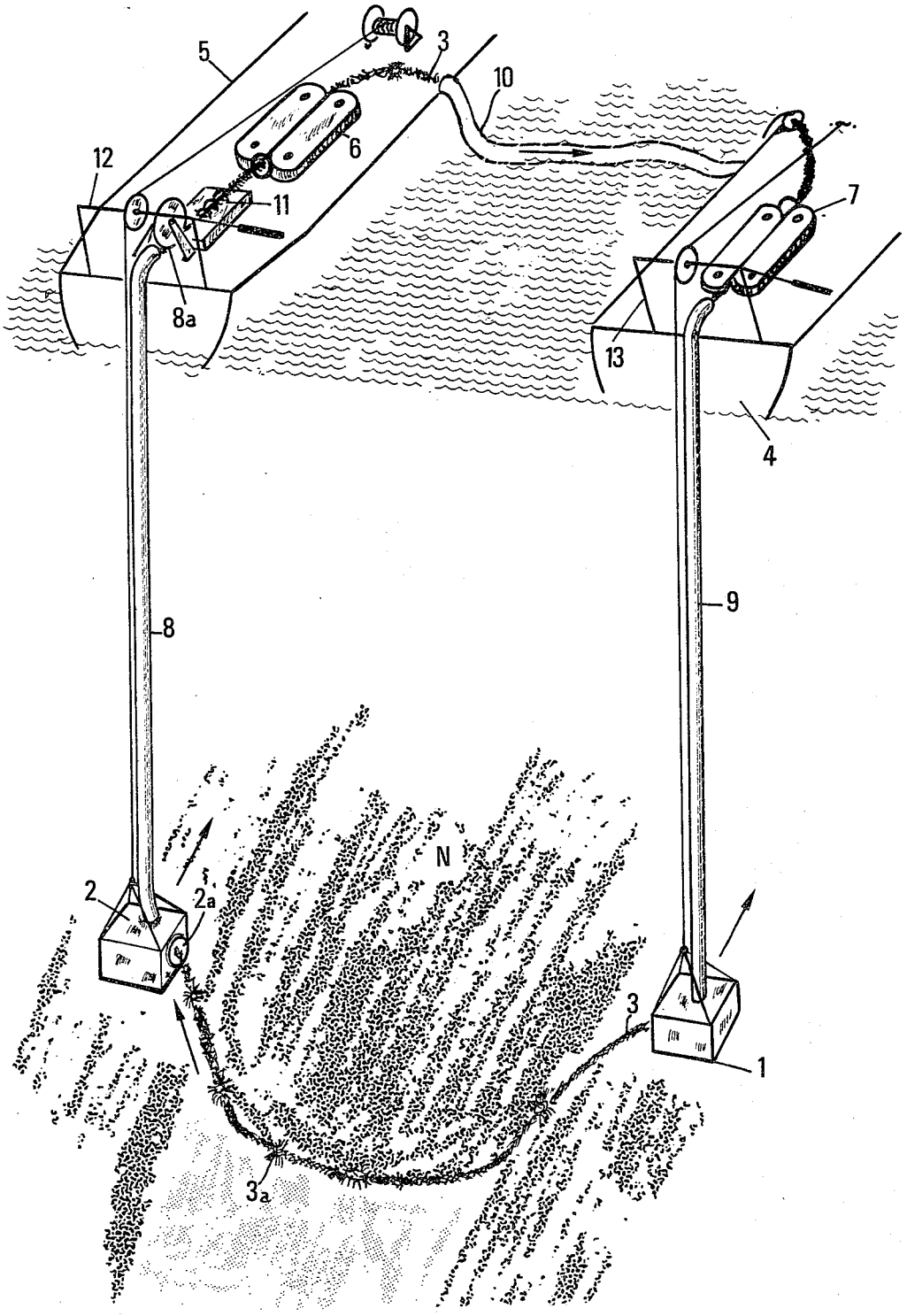
5
3
10
6
12
11
7
8a
13
4
8
9
N
2
2a
3
1
3a

METHOD AND SYSTEM FOR THE CONTINUOUS CLEANING OF UNDERWATER BEDS

BACKGROUND OF THE INVENTION

The present invention relates to a method and system for continuous cleaning of the underwater bottom, making it possible to hoist up to the surface heavy viscous products deposited or scattered at the water bottom, as result of a leakage from oil-fuel tanks of stranded or sunken ships creating pollution.

Such products may, for example, be hydrocarbons or heavy oil residues having a specific gravity higher than that of the surrounding water, and which can not be effectively collected mechanically, for example, by dredging. Dredging of these products might be contemplated but would suffer from the following major drawbacks:

conveyance of very large quantities of inert material (sand and water) from the water bottom, resulting in difficult separation and discharge problems, unavoidable tar scattering (i.e., enlargement polluted zone), requirement of a pumping system having a pumping rate of about 500 $m^3$/hours, which is abrasion resistant, capable of being steadily displaced on the water bottom, and not very sensitive to water currents.

SUMMARY OF THE INVENTION

The technique according to the invention comprises hoisting the products by means of flexible line means which is circulated between the water bottom and the water surface.

Systems based on the circulation of a flexible line for hoisting up materials deposited on the water bottom are already known, for example from French Pat. No. 2,404,584, Swiss Pat. No. 267,070, or U.S. Pat. No. 4,055,006.

It is already known from U.S. Pat. No. 3,744,638 to make use of an endless line provided with strips of plastic material, to remove hydrocarbons spilled on the surface of a body of water.

The techniques described in the above-identified patents are however, not applicable to the above-described problem of cleaning the water bottom.

As a matter of fact, if these prior techniques are used to solve this problem, the water layer above the products scattered at the water bottom is likely to be soiled by a water suspension of the polluting products hoisted to the water surface by the collecting flexible line.

The invention provides a method and a system whereby the above indicated problems can be solved.

BRIEF DESCRIPTION OF THE DRAWING

An embodiment of the invention is illustrated by way of example in the accompanying drawing.

DETAILED DISCUSSION

The layer of products scattered at the water bottom and which must be collected is designated by reference N.

In the system according to the invention, there is displaced between two points 1 and 2, located in the vicinity of the water bottom, a flexible line 3 provided with hairs or strips, acting like a swab or mop on a ship's deck (i.e. as a broom provided with ropes, which is used to dry the deck after rain). The flexible line is thereafter continuously wringed dry or squeezed aboard a surface installation.

The hairs of the line 3 will preferably be made of a synthetic material which does not absorb the products to be collected but superficially retains these products. They can be made like the hairs of rotary brushes used for car cleaning.

It will also be possible to use a line covered by a helical wrapping of a continuous band of "synthetic grass," or looped or knop wool carpet, or any other similar coating (an oleophilic coating when the collected products are hydrocarbons).

Two marine surface supports 4 and 5 remain separated on the surface at a substantial distance from each other, for example from 80 to 100 meters. The two surface supports 4 and 5 are equipped with continuous pulling means 6 and 7 respectively (e.g., endless chain traction means, capstans . . . ) which provide for a continuous displacement of the line 3 whose overall length depends on the distance between the surface supports 4 and 5, and on the water depth.

To prevent any additional pollution of the marine environment, and to guide the polluting products, the line 3 traverses the water layer to the surface through a flexible casing 8 protecting the rising portion of its path, as the line 3, loaded with polluting products, hoists these products up to the water surface. In the illustrated embodiment, the line 3 is also surrounded with a flexible casing 9 protecting the downward portion of its path toward the vicinity of the water bottom.

Similarly, between the two marine supports 4 and 5, the line 3 passes through a floating flexible casing 10. Thus, only when the line 3 is on the bottom is it exposed to direct contact with the surrounding water.

The polluting products are prevented from falling down into the flexible casing 8, and the latter is cleaned by flue brushes **3*a* positioned at regular interval along the line 3**.

The two flexible casings 8 and 9 are weighted at their lower part by means of two heavy members 1 and 2 of a sufficient weight to maintain a substantially constant spacing of the tubular casings 8 and 9 at their lower end, in spite of the traction force applied to line 3, and to maintain the flexible casings 8 and 9 in a substantially vertical position, in spite of the water currents.

Each of the heavy members 1 and 2 is provided with an internal passageway for line 3. The passageway opens out through an orifice such as **2*a* on a lateral wall of each heavy member. Whenever necessary, the line 3 may be weighted at invervals by the small masses, so that between the members 1 and 2, the line 3** is properly held down by gravity against the layer N of the product to be collected.

Dry wringing of line 3 is provided by passing this line through a series of scraper means 11. After this operation, any polluting product which may remain on the hairs of line 3 can be removed by passing this line through a washing unit (not shown).

OPERATION OF THE SYSTEM

In the harbour, the marine support 5 is equipped with a cross-beam 12. The heavy member 2 is stored under the beam 12, and the flexible casing 8 is stored on a drum (not shown) located on the other side of the endless chain traction device 6 with respect to the beam 12. The flexible line 3 is stored on another drum located in front of the preceding drum, i.e. at a greater distance from the beam 12.

The flexible casing 8 is stored on a third drum located near the aforementioned drums.

The support 4 is equipped with a beam 13 under which the heavy member 1 is stored.

The flexible casing 9 is stored on a (not shown) drum located on the other side of the endless chain traction device 7, with respect to the beam 13.

Upon arrival on the site where cleaning operations are to be carried out, the flexible casing 8 is unreeled, introduced into the endless chain traction device 6 and connected to the heavy member 2.

The latter is then moved off the side of the support 5, by means of the beam 12 and submerged together with the flexible casing 8. The heavy member 2 is immobilized at a few meters from the water bottom, and the end 8*a* of the flexible casing 8 is connected to the stern of the support 5.

The same operation is carried out aboard the marine support 4 for the flexible casing 9. The flexible line 3 is then unreeled, passed through the endless chain traction device 6 and connected to a first end of a pulling cable running through the flexible casing 8, the second end of this cable being kept aboard the marine support 5 during the immersion of the flexible casing 8.

This second end of the cable is then connected to the second end of a similar cable on the marine support 4.

The first end of this latter cable is then reeled on a winch aboard the marine support 4.

The endless chain traction device 6 is then actuated and by reeling on the above-mentioned winch the end of the line 3 is hauled on board the support 4. This line is then introduced into the traction device 7.

The floating flexible casing 10 is thereafter set afloat, and its ends are secured to the supports 4 and 5.

At the outlet of the traction device 7, the line 3 is connected to a pulling cable running through the flexible casing 10, then hauled on board the supports and connected to the other end of this line 3 which is already located on the support 5.

We claim:

1. A method of continuously hoisting up heavy viscous products from the water bottom to the surface, comprising circulating through the water from the surface a flexible line having collecting means for collecting said products by having the products superficially retained thereon, passing said line through a path having a downward portion bringing said collecting means into contact with the products on the water bottom, and a rising portion of the path for hoisting the products up to the water surface, wherein along said rising portion of the path the collecting means is passed through a tubular casing for protecting the surrounding water above the bottom against pollution by preventing said products from being disengaged from the flexible line, while hoisting the products to the surface.

2. A system for continuously hoisting up heavy viscous products from the water bottom to the surface, comprising a flexible line provided with collecting means for collecting the products, said collecting means adapted for having said products superficially retained thereon upon contact, circulating means for circulating said flexible line through the water along a path comprising a downward portion for bringing said collecting means into contact with the products on the water bottom, and a rising portion for hoisting these products to the surface, means for recovering the products at the water surface, and a tubular casing located along said rising portion of the underwater path of the flexible line, said tubular casing surrounding the flexible line for protecting the adjacent water body against pollution, while allowing hoisting of the products to the surface therethrough.

3. A system according to claim 2, adapted for hoisting polluting viscous products to the water surface, said system comprising at the surface traction means for circulating said flexible line along a closed loop, means for continuously wringing or squeezing the products carried along by this line, said system further comprising a second tubular casing which surrounds said flexible line along said downward portion of it path.

4. A system according to claim 2, wherein said collecting means for collecting the products are hairs or strips surrounding said flexible line, said line having secured thereto a plurality of flue brushes means located in space relationship along this flexible line.

5. A system according to claim 3, wherein said tubular casings are supported from the water surface by two separate floating supports.

6. A system according to claim 5, wherein said two floating supports are connected by a flexible tubular guide wherethrough the flexible line passes.

7. A system according to claim 3, wherein said tubular casings are vertical tubular pipes provided with weighting means at their lower end.

8. A method of continuously hoisting up heavy viscous products, deposited or scattered at the water bottom, to the water surface, comprising the sequential steps of:

(a) passing a flexible line, having collecting means, in contact with said heavy viscous products on the water bottom for collecting said heavy viscous products, said collecting means adapted for having said heavy viscous products superficially retained thereon and not absorbed thereby;

(b) raising said flexible line, having said heavy viscous products attached thereon, through tubular protecting means to the surface of the water for preventing the heavy viscous products from becoming disengaged from said flexible line;

(c) removing the collected heavy viscous products from said flexible line at the surface; and (d) lowering said flexible line, having the collected heavy viscous products removed therefrom, downwardly to the water bottom through tubular protecting means for preventing any remaining heavy viscous products retained thereon from becoming disengaged therefrom and polluting the water, to thereby continuously repeat steps (a) through (d).

9. An apparatus for continuously hoisting up heavy viscous products, deposited or scattered at the water bottom, to the water surface, comprising:

a flexible line having collecting means adapted for having said heavy viscous products superficially retained thereon upon contact;

circulating means associated with said flexible line for continuously circulating said flexible line between the water surface and the water bottom;

first protecting tubular means adapted for having said flexible line passed upwardly therethrough from the water bottom to the water surface and for preventing heavy viscous products attached to the flexible line being passed therethrough from being disengaged therefrom to pollute the surrounding water;

recovery means located on the water surface and arranged for having said flexible line passed therethrough for removing and collecting collected heavy viscous products from said flexible line; and second protecting tubular means adapted for having said flexible line passed downwardly therethrough from the water surface, after having collected heavy viscous products removed therefrom, to the water bottom and for preventing any remaining heavy viscous products retained on the flexible line from being disengaged therefrom to pollute the surrounding water.

10. A method as in claim 1 or 8 wherein said collecting means on said flexible line comprises hairs for collecting said heavy viscous products.

11. A method as in claim 1 or 8 wherein said collecting means on said flexible line comprises a plurality of plastic strips surrounding said flexible line for collecting said heavy viscous products.

12. A method as in claim 1 or 8 wherein said collecting means on said flexible line comprises a helical wrapping of a continuous band of looped carpet for collecting said heavy viscous products.

13. A method as in claim 1 or 8 wherein said collecting means on said flexible line comprises a helical wrapping of a continuous band of synthetic grass for collecting said heavy viscous products.

14. A system as in claim 2 or 9 wherein said collecting means comprises a helical wrapping of a continuous band of synthetic grass.

15. A system as in claim 2 or 9 wherein said collecting means comprises a helical wrapping of a continuous band of looped carpet.

* * * * *